US011224280B2

(12) United States Patent
Duncan

(10) Patent No.: US 11,224,280 B2
(45) Date of Patent: Jan. 18, 2022

(54) TACTICAL STRAP

(71) Applicant: H6 Tactical, Inc., St. Petersburg, FL (US)

(72) Inventor: Sean C Duncan, Tampa, FL (US)

(73) Assignee: H6 Tactical, Inc., St. Petersburg, FL (US)

( * ) Notice: Subject to any disclaimer, the term of this patent is extended or adjusted under 35 U.S.C. 154(b) by 0 days.

(21) Appl. No.: 16/032,134

(22) Filed: Jul. 11, 2018

(65) Prior Publication Data

US 2019/0014888 A1 Jan. 17, 2019

Related U.S. Application Data

(60) Provisional application No. 62/530,965, filed on Jul. 11, 2017.

(51) Int. Cl.

| | |
|---|---|
| ***A45F 3/14*** | (2006.01) |
| ***A45C 13/30*** | (2006.01) |
| *A45F 3/02* | (2006.01) |

(52) U.S. Cl.

CPC ..... *A45F 3/14* (2013.01); *A45C 13/30* (2013.01); *A45F 3/02* (2013.01); *A45F 2003/142* (2013.01); *A45F 2200/0516* (2013.01)

(58) Field of Classification Search

CPC ..... A45F 3/14; A45F 2003/142; A45F 2200/0516

USPC ..... 224/611

See application file for complete search history.

(56) References Cited

U.S. PATENT DOCUMENTS

| | | | | |
|---|---|---|---|---|
| 2,025,886 | A * | 12/1935 | Nordstrom | A41F 9/002 224/587 |
| 4,525,879 | A * | 7/1985 | Kalomeris | A45C 1/04 2/247 |
| 6,015,073 | A | 1/2000 | Wojciak | |
| 6,067,661 | A * | 5/2000 | Bates | A41F 9/002 2/250 |
| 7,090,102 | B1 | 8/2006 | Lipke | |
| 2007/0084895 | A1 * | 4/2007 | Bowen | A45C 1/04 224/660 |
| 2008/0006668 | A1 | 1/2008 | Nowacki | |
| 2008/0217369 | A1 * | 9/2008 | Sloot | A61F 5/0104 224/222 |
| 2011/0036878 | A1 | 2/2011 | Cartwright | |
| 2012/0074192 | A1 | 3/2012 | Murdoch | |
| 2016/0081446 | A1 | 3/2016 | Maddox et al. | |

OTHER PUBLICATIONS

Sherpa Guide S2Delta Tactical Sling—Best 2 Point Sling for the Price? YouTube Apr. 10, 2017 [retrived on Aug. 27, 2018]. Retrieved from Internet: <URL: https://www.youtube.com/watch?v=sE1w_2wYW6Y>. entire video. See pp. 7-8 of the ISA/237.

* cited by examiner

*Primary Examiner* — Peter N Helvey

(57) ABSTRACT

A tactical strap includes an elongated body, a plurality of tabs, and a pouch. The elongated body has a first end, an opposing second end, a front surface, and a rear surface. The plurality of tabs are spaced along at least a portion of the front surface of the elongated body. The pouch is attached to the front surface of the elongated body proximate the first end. The pouch defines a cavity that is selectively accessible.

15 Claims, 4 Drawing Sheets

TACTICAL STRAP

CROSS-REFERENCE TO RELATED PATENT APPLICATIONS

This application claims the benefit of U.S. Provisional Application No. 62/530,965, filed Jul. 11, 2017, which is incorporated herein by reference in its entirety.

BACKGROUND

The present disclosure relates to a tactical strap, and more specifically to a tactical radio strap. Radio straps may be used to secure radios around a user's shoulders and are traditionally limited to carrying only a radio.

SUMMARY

One embodiment relates to a tactical strap for a holster. The tactical strap includes an elongated body, a plurality of tabs, and a pouch. The elongated body has a first end, an opposing second end, a front surface, and a rear surface. The plurality of tabs are spaced along at least a portion of the front surface of the elongated body. The pouch is attached to the front surface of the elongated body proximate the first end. The pouch defines a cavity that is selectively accessible.

Another embodiment relates to a strap. The strap includes an elongated body, a flap, a first reducer, a second reducer, a first connector, and a second connector. The elongated body has a first end, an opposing second end, a front surface, and a rear surface. The front surface has a first coupler attached thereto proximate the first end. The flap is attached to the front surface of the elongated body proximate the first end. The flap has a second coupler attached thereto and positioned to selectively engage with the first coupler to enclose a cavity defined between the front surface of the elongated body and the flap. The first reducer has a first strap end defining a first aperture and a first connector end defining a second aperture. The first aperture receives the first end of the elongated body to secure the first reducer to the elongated body. The first strap end has a first width and the first connector end has a second width that is less than the first width. The second reducer has a second strap end defining a third aperture and a second connector end defining a fourth aperture. The third aperture receives the opposing second end of the elongated body to secure the second reducer to the elongated body. The second strap end has a third width and the second connector end has a fourth width that is less than the third width. The first connector is coupled to the first connector end of the first reducer via the second aperture. The second connector is coupled to the second connector end of the second reducer via the fourth aperture.

Still another embodiment relates to a kit for carrying a communication device. The kit includes a holster configured to receive the communication device and a strap selectively couplable to the holster. The holster includes a pair of connectors. The strap includes an elongated body, a plurality of tabs, a flap, a first connector, and a second connector. The elongated body has a first end, an opposing second end, a front surface, and a rear surface. The plurality of tabs are spaced along at least a portion of the front surface of the elongated body. The flap is attached to the front surface of the elongated body proximate the first end. A portion of the flap is selectively securable to the front surface to enclose a cavity defined between the front surface of the elongated body and the flap. The first connector is coupled to the first end of the elongated body. The second connector is coupled to the opposing second end of the elongated body. The first connector and the second connector are configured to selectively interface with the pair of connectors of the holster to secure the holster to the strap.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
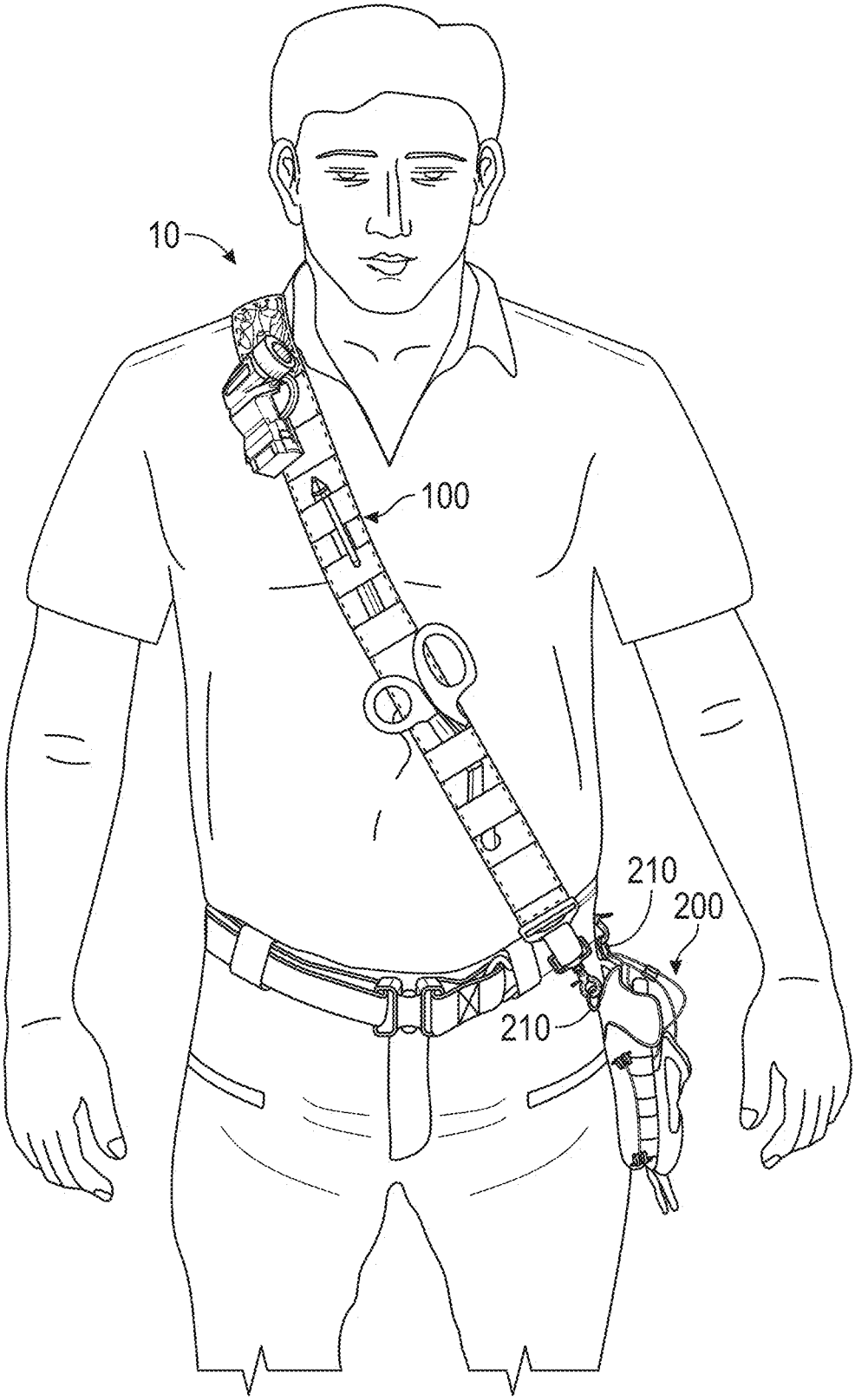
FIG. 1 is a perspective view of a strap and holster kit, according to an exemplary embodiment.
Figure 2:
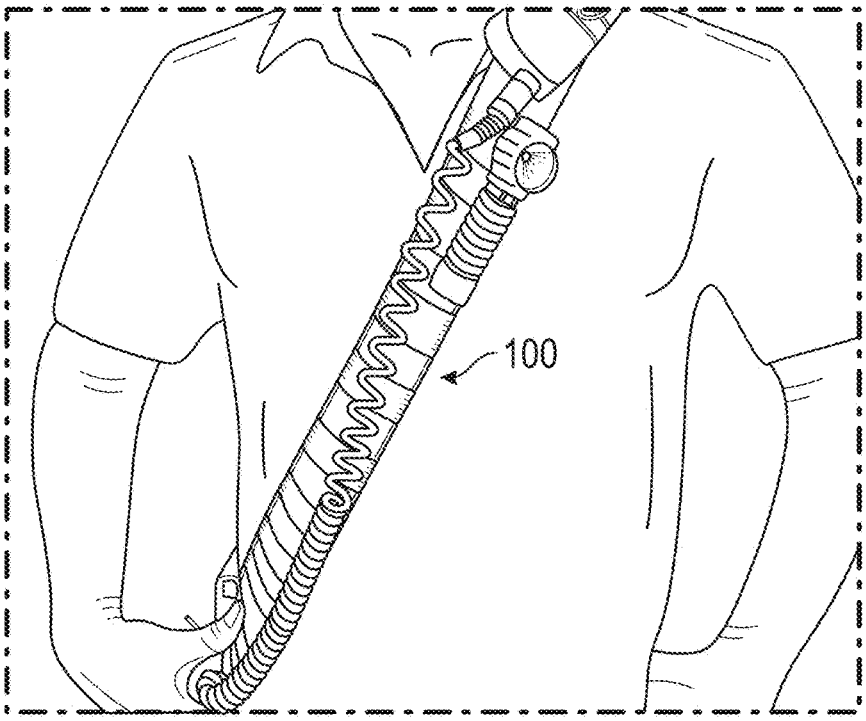
FIGS. 2-4 are various views of a strap of the strap and holster kit of FIG. 1, according to an exemplary embodiment.

According to the exemplary embodiment shown in FIGS. 1-6, a strap and holster kit, shown as strap and holster assembly 10, includes a strap, shown as tactical strap 100, and a device holder, shown as holster 200, selectively couplable to the tactical strap 100. As shown in FIGS. 1 and 2, the strap and holster assembly 10 is configured to extend around a person's torso (e.g., around the person's shoulder and hip, etc.) and facilitate carrying various devices or items (e.g., a radio, a flashlight, pens, scissors, etc.). The strap and holster assembly 10 may be used by firemen, police officers, security guards, paramedics, EMTs, military personnel, and the like. According to an exemplary embodiment, the holster 200 is configured to receive and secure a device therein. By way of example, the holster 200 may be configured to receive and secure a communications device therein. The communications device may include a radio device, a walkie-talkie, a cell phone, a smart phone, and/or any other portable user communications device. By way of another example, the holster 200 may be configured to receive and secure any device (e.g., a hand tool, a weapon, a knife, a gun, a water bottle, etc.) that fits therein.

Figure 3:
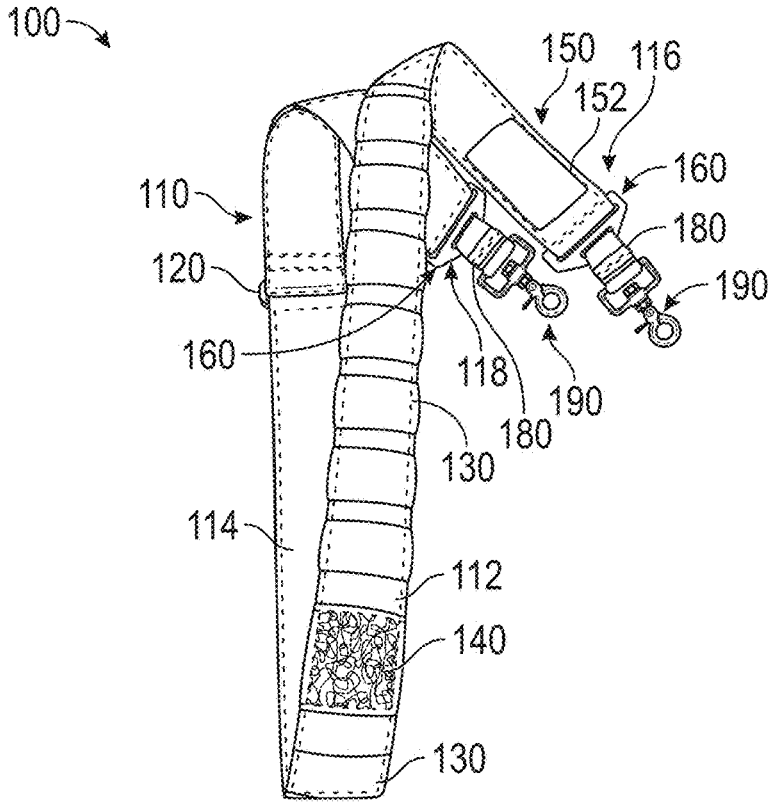
Figure 4:
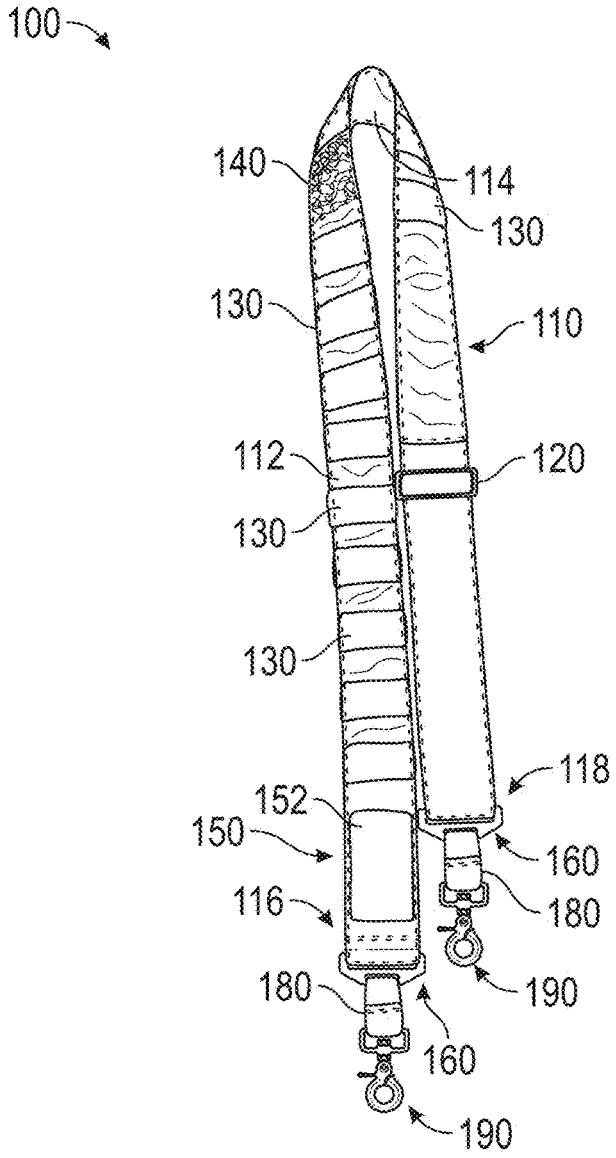
Figure 5:
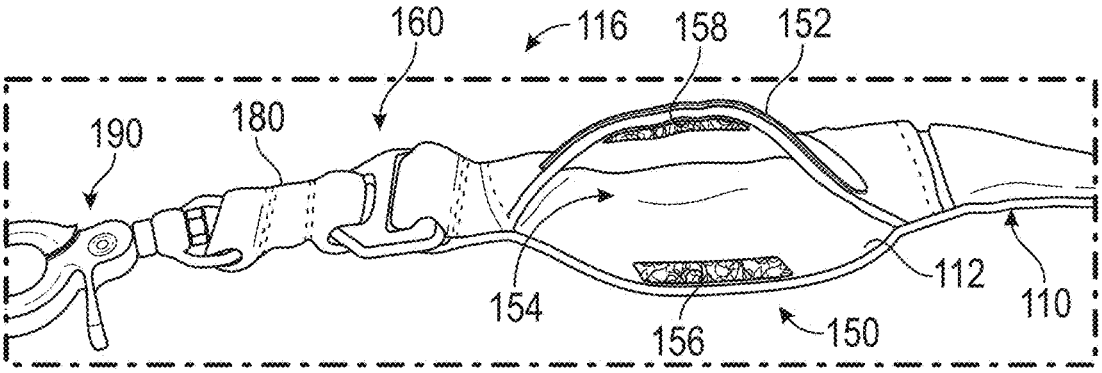
FIG. 5 is a detailed view of a pouch of the strap of FIGS. 2-4, according to an exemplary embodiment.

As shown in FIGS. 3-5, the tactical strap 100 includes a main body (e.g., a strap, a belt, etc.), shown as elongated body 110, having a first face, shown as front surface 112, an opposing second face, shown as rear surface 114, a first end, shown as first end 116, and an opposing second end, shown as second end 118. As shown in FIGS. 3 and 4, the tactical strap 100 includes an adjuster, shown as adjustment buckle 120, positioned along the elongated body 110 between the first end 116 and the second end 118. According to an exemplary embodiment, the adjustment buckle 120 is selectively repositionable along a portion of the length of the elongated body 110 to facilitate lengthening or shortening the tactical strap 100 as the user thereof desires (e.g., for improved fit, comfort, etc.).

As shown in FIGS. 3 and 4, the tactical strap 100 includes a plurality of tabs, shown as tabs 130, spaced along at least a portion of the front surface 112 of the elongated body 110. The tabs 130 each include a first end and an opposing second end coupled (e.g., stitched, sewn, with adhesive, etc.) to the front surface 112 to form a loop therewith. As shown in FIGS. 1 and 2, a user of the tactical strap 100 can use the tabs 130 to secure various items (e.g., scissors, pens, flashlights, etc.) to the tactical strap 100.

As shown in FIGS. 3 and 4, the tactical strap 100 includes a patch, shown as hook and loop fastener patch 140, disposed on (e.g., sewn to, stitched to, adhesively secured to, etc.) the front surface 112 of the elongated body 110 at a position between a first grouping of the tabs 130 and a second grouping of the tabs 130 (e.g., the hook and loop fastener patch 140 separates the tabs 130 into two groups of tabs 130, etc.). According to an exemplary embodiment, the hook and loop fastener patch 140 is configured to releasably secure a component of a radio communication device (e.g., a handheld radio mic component coupled to a base radio unit within the holster 200 via a corded connection, etc.) to the elongated body 110 of the tactical strap 100.

Figure 7:
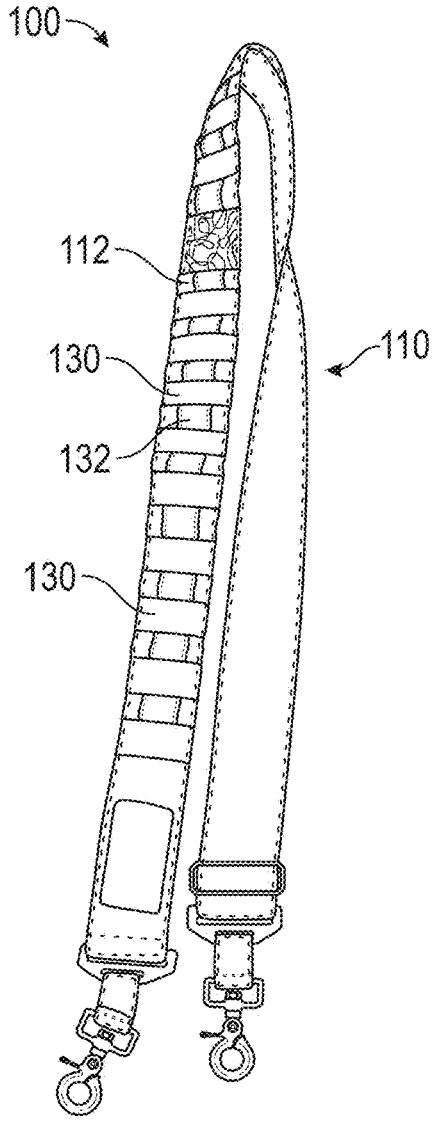
FIG. 7 is a perspective view of a strap of the strap and holster kit of FIG. 1, according to another exemplary embodiment.
Figure 8:
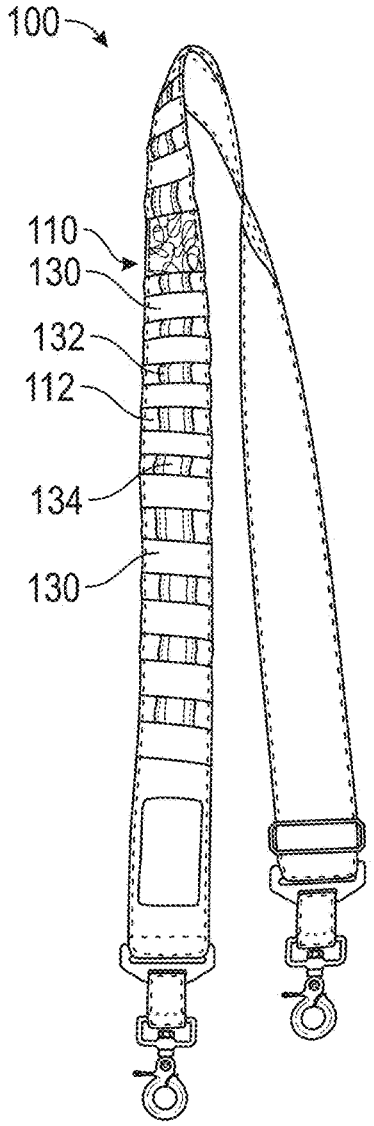
FIG. 8 is a perspective view of a strap of the strap and holster kit of FIG. 1, according to still another exemplary embodiment.

As shown in FIGS. 7 and 8, the tactical strap 100 includes a first strip, shown as reflective strip 132, coupled (e.g., attached, sewn, stitched, adhesively secured, etc.) to and extending along at least a portion of the front surface 112 of the elongated body 110 such that the tabs 130 extend over the reflective strip 132. In other embodiments, the reflective strip 132 includes a plurality of reflective strip portions coupled to a plurality of the tabs 130. As shown in FIG. 8, the tactical strap 100 includes a second strip, shown as glow-in-the-dark strip 134, disposed over the reflective strip 132. The glow-in-the-dark strip 134 has a width less than that of the reflective strip 132. In other embodiments, the glow-in-the-dark strip 134 includes a plurality of glow-in-the-dark strip portions coupled to a plurality of the tabs 130. In other embodiments, the tactical strap 100 includes the glow-in-the-dark strip 134 and not the reflective strip 132. In still other embodiments, the tactical strap 100 additionally or alternatively includes an illuminating strip (e.g., a strip having a plurality of light emitting diodes (LEDs) and a power source such as a battery, etc.).

As shown in FIGS. 3-5, the tactical strap 100 includes a pouch, shown as pouch 150, positioned proximate to the first end 116 of the elongated body 110. In other embodiments, the pouch 150 is positioned proximate the second end 118 of the elongated body 110. In still other embodiments, the tactical strap 100 includes two pouches 150, one positioned proximate the first end 116 and the other positioned proximate the second end 118. As shown in FIGS. 3-5, the pouch 150 may include a flap, shown as pouch flap 152, coupled (e.g., attached, stitched, sewn, adhesively secured, etc.) to the front surface 112 of the elongated body 110, having at least one edge thereof selectively and releasably securable to the front surface 112 of the elongated body 110. The pouch 150 may otherwise be integrated into the elongated body 110.

As shown in FIG. 5, the pouch flap 152 and the front surface 112 of the elongated body 110 cooperatively define a cavity, shown as pocket 154. The front surface 112 of the elongated body 110 has a first coupler, shown as coupler 156, attached thereto proximate the first end 116. The pouch flap 152 has a second coupler, shown as coupler 158, attached to an interior surface thereof and positioned to selectively engage with the coupler 156 to enclose the pocket 154 to form a closure system that facilitates selectively accessing the pocket 154. The pocket 154 may be configured to selectively receive and hold an item (e.g., a key, pepper spray, latex gloves, etc.) therein. According to the exemplary embodiment shown in FIG. 5, the coupler 156 and the coupler 158 are hook and loop fasteners. In other embodiments, another type of closure system is used to selectively secure the pouch flap 152 to the elongated body 110. By way of example, the coupler 156 and the coupler 158 may be a snap button closure system. By way another example, the coupler 156 and the coupler 158 may be a zipper closure system. By way of yet another example, the coupler 156 and the coupler 158 may be a magnetic closure system. By way of yet still another example, the coupler 156 and the coupler 158 are still another suitable closure system.

As shown in FIGS. 3-5, each of the first end 116 and the second end 118 of the elongated body 110 includes a reducer, shown as reducer 160, coupled to first end 116 and the second end 118, respectively; an extension, shown as connector strap 180, coupled to and extending from the reducer 160; and a securing element (e.g., a buckle, a clip, a tie, a clasp, a swivel clasp, etc.), shown as connector 190, coupled to the connector strap 180. According to an exemplary embodiment, the connector straps 180 have widths that are less than that of the elongated body 110 (e.g., the connector straps 180 may be approximately half the width of the elongated body 110, etc.).

Figure 6:
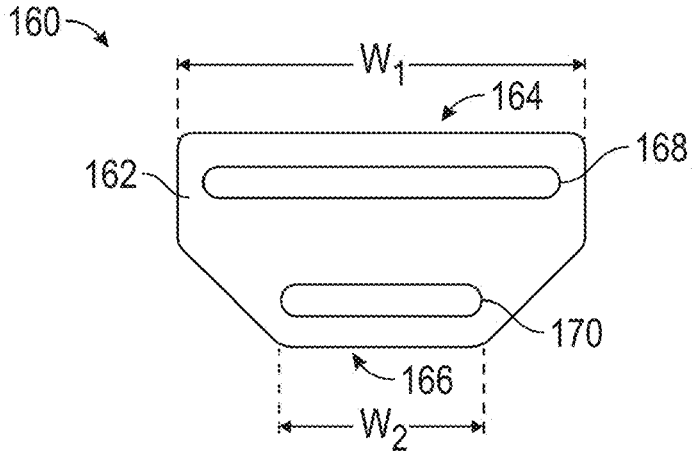
FIG. 6 is a detailed view of a reducer of the strap of FIGS. 2-4, according to an exemplary embodiment.

As shown in FIG. 6, the reducer 160 includes a body, shown as plate 162. The plate 162 (*i*) has a first end, shown as strap end 164, and an opposing second end, shown as connector end 166 and (ii) defines a first aperture, shown as strap aperture 168, positioned proximate the strap end 164 and a second aperture, shown as connector aperture 170, positioned proximate the connector end 166. The strap aperture 168 receives the first end 116 or the second end 118 of the elongated body 110 to secure the reducer 160 to the elongated body 110. The connector strap 180 extends from the connector aperture 170 to one of the connectors 190 to secure the connector 190 to the reducer 160. As shown in FIG. 6, the strap end 164 of the reducer 160 has a first width $W_1$ corresponding to a width of the elongated body 110 and the connector end 166 of the reducer 160 has a second width $W_2$ corresponding to a width of the connector strap 180. According to an exemplary embodiment, the second width $W_2$ is less than the first width $W_1$. In one embodiment, the first width $W_1$ is at least twice the second width $W_2$ (e.g., the first width $W_1$ is approximately two inches and the second width $W_2$ is approximately one inch, etc.).

As shown in FIG. 1, the holster 200 includes a pair of connectors, shown as holster connectors 210. The connectors 190 of the tactical strap 100 are configured to selectively interface with the holster connectors 210 of the holster 200 to secure the holster 200 to the tactical strap 100, and thereby form the strap and holster assembly 10. The elongated body 110 may be manufactured from nylon, canvas, Kevlar, cloth, rip stop, and/or other pliable materials that may be sewn. The material of the elongated body 110 may be durable and washable using extractors that aid in removing carcinogen particulates (e.g., from a fire, which are often retained in straps made of leather, etc.). In some embodiments, the elongated body 110, the reducers 160, the connector straps 180, and the connectors 190 are sized and/or selected with sufficient strength and/or durability to support the weight of a person (e.g., in a fire rescue scenario, etc.).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

The invention claimed is:

1. A tactical strap for a holster, the holster including a pair of connectors and configured to receive a communication device, and the tactical strap comprising:

an elongated body having a first end, an opposing second end, a front surface, and a rear surface;

a plurality of tabs spaced along at least a portion of the front surface of the elongated body;

a pouch attached to the front surface of the elongated body proximate the first end and positioned between the plurality of tabs and the first end, the pouch comprising a first enclosed end proximate the first end, a second enclosed end opposite the first enclosed end, an enclosed bottom defining a cavity of a pocket and an opening opposite the enclosed bottom that is selectively accessible and configured to selectively receive and hold an item;

a hook and loop fastener patch disposed on the front surface of the elongated body at a position between a first grouping of the plurality of tabs and a second grouping of the plurality tabs, wherein the first grouping of the plurality of tabs is at least two tabs and wherein the second grouping of the plurality of tabs is at least two tabs;

a first reducer coupled to the first end of the elongated body and a second reducer coupled to the opposing second end of the elongated body; and a first connector coupled to the first reducer and a second connector coupled to the second reducer, wherein the first connector and the second connector are configured to selectively interface with the pair of connectors of the holster to secure the holster to the strap.

2. The tactical strap of claim 1, wherein the front surface has a first coupler attached thereto, and wherein the pouch includes a flap having a second coupler attached thereto and positioned to selectively engage with the first coupler to enclose the cavity.

3. The tactical strap of claim 1, further comprising an adjuster coupled to the elongated body between the first end and the opposing second end, the adjuster configured to facilitate selectively adjusting a length of the elongated body.

4. The tactical strap of claim 1, further comprising a reflective strip attached to the front surface of the elongated body, wherein the plurality of tabs extend over the reflective strip.

5. The tactical strap of claim 4, further comprising a glow-in-the-dark strip disposed over the reflective strip, the glow-in-the-dark strip having a width less than that of the reflective strip.

6. The tactical strap of claim 1, wherein the first reducer includes a plate having a strap end defining a first aperture and a connector end defining a second aperture, the first aperture receives the first end of the elongated body to secure the first reducer to the elongated body.

7. The tactical strap of claim 6, further comprising a first connector strap extending from the second aperture to the first connector to secure the first connector to the first reducer.

8. The tactical strap of claim 7, wherein the strap end of the first reducer has a first width corresponding to a width of the elongated body and the connector end of the first reducer has a second width corresponding to a width of the first connector strap, the second width being less than the first width.

9. The tactical strap of claim 8, wherein the first width is at least twice the second width.

10. A strap comprising:

a holster including a pair of connectors, the holster configured to receive a communication device;

an elongated body having a first end, an opposing second end, a front surface, and a rear surface, wherein the front surface has a first coupler attached thereto proximate the first end;

a flap attached to the front surface of the elongated body proximate the first end, the flap having a second coupler attached thereto and positioned to selectively engage with the first coupler to enclose a cavity of a pocket defined between the front surface of the elongated body and the flap, the pocket configured to selectively receive and hold an item and comprising a first enclosed end proximate the first end, a second enclosed end opposite the first enclosed end, an enclosed bottom defining the cavity of the pocket and an opening opposite the enclosed bottom;

a plurality of tabs spaced along at least a portion of the front surface of the elongated body, wherein the flap and the cavity of the pocket are positioned between the plurality of tabs and the first end;

a hook and loop fastener patch disposed on the front surface of the elongated body at a position between a first grouping of the plurality of tabs and a second grouping of the plurality tabs, wherein the first grouping of the plurality of tabs is at least two tabs and wherein the second grouping of the plurality of tabs is at least two tabs;

a first reducer having a first strap end defining a first aperture and a first connector end defining a second aperture, the first aperture receives the first end of the elongated body to secure the first reducer to the elongated body, wherein the first strap end has a first width and the first connector end has a second width that is less than the first width; a second reducer having a second strap end defining a third aperture and a second connector end defining a fourth aperture, the third aperture receives the opposing second end of the elongated body to secure the second reducer to the elongated body, wherein the second strap end has a third width and the second connector end has a fourth width that is less than the third width;

a first connector coupled to the first connector end of the first reducer via the second aperture; and a second connector coupled to the second connector end of the second reducer via the fourth aperture, wherein the first connector and the second connector are configured to selectively interface with the pair of connectors of the holster to secure the holster to the strap.

11. The strap of claim 10, wherein the first width is at least twice the second width and the third width is at least twice the fourth width, wherein (i) the first width and the third width are the same and (ii) the second width and the fourth width are the same.

12. The strap of claim 10, further comprising:

a first connector strap extending between the second aperture of the first reducer and the first connector; and a second connector strap extending between the fourth aperture of the second reducer and the second connector;

wherein the first connector strap and the second connector strap have widths that are less than that of the elongated body.

13. The strap of claim 10, further comprising a reflective strip attached to and extending along at least a portion of the front surface of the elongated body.

14. The strap of claim 13, further comprising a glow-in-the-dark strip disposed over the reflective strip, the glow-in-the-dark strip having a width that is less than that of the reflective strip.

15. A kit for carrying a communication device, the kit comprising:

a holster including a pair of connectors, the holster configured to receive the communication device;

a strap selectively couplable to the holster, the strap including:

an elongated body having a first end, an opposing second end, a front surface, and a rear surface;

a plurality of tabs spaced along at least a portion of the front surface of the elongated body;

a hook and loop fastener patch disposed on the front surface of the elongated body at a position between a first grouping of the plurality of tabs and a second grouping of the plurality tabs, wherein the first grouping of the plurality of tabs is at least two tabs and wherein the second grouping of the plurality of tabs is at least two tabs;

a flap attached to the front surface of the elongated body proximate the first end and positioned between the plurality of tabs and the first end, a portion of the flap selectively securable to the front surface to enclose a cavity of a pocket defined between the front surface of the elongated body and the flap, the pocket configured to selectively receive and hold an item and comprising a first enclosed end proximate the first end, a second enclosed end opposite the first enclosed end, an enclosed bottom defining the cavity of the pocket and an opening opposite the enclosed bottom;

a first connector coupled to the first end of the elongated body; and a second connector coupled to the opposing second end of the elongated body;

wherein the first connector and the second connector are configured to selectively interface with the pair of connectors of the holster to secure the holster to the strap.

* * * * *